United States Patent [19]

Mikkola

[11] Patent Number: 4,891,184

[45] Date of Patent: Jan. 2, 1990

[54] LOW DENSITY HEAT RESISTANT INTERMETALLIC ALLOYS OF THE $AL_3TI$ TYPE

[76] Inventor: Donald E. Mikkola, 206 Clark St., Houghton, Mich. 49931

[21] Appl. No.: 289,543

[22] Filed: Dec. 23, 1988

[51] Int. Cl.[4] ..... C22C 21/00; C22C 30/00

[52] U.S. Cl. ..... 420/553; 420/552; 420/580; 420/589

[58] Field of Search ..... 420/552, 553, 580, 588; 148/437

[56] References Cited

U.S. PATENT DOCUMENTS

| | | | |
|---|---|---|---|
| 2,750,271 | 6/1956 | Cueilleron et al. | 420/552 |
| 3,391,999 | 7/1968 | Cole et al. | 420/552 |

FOREIGN PATENT DOCUMENTS

| | | | |
|---|---|---|---|
| 8642 | 3/1978 | Japan | 420/552 |
| 124241 | 6/1987 | Japan . | |
| 270704 | 11/1987 | Japan . | |
| 1394449 | 5/1975 | United Kingdom | 420/552 |

*Primary Examiner*—Robert McDowell

*Attorney, Agent, or Firm*—Michael, Best & Friedrich

[57] ABSTRACT

Low density, high temperature and aluminum-rich intermetallic alloys displaying excellent elevated temperature properties, including oxidation resistance, are disclosed. Based on the aluminum/titanium system, specifically modifications of $Al_3Ti$ compositions, useful alloys are derived from changes in crystal structure and properties effected by selected-site substitution alloying with manganese, or chromium, and, where used, vanadium, or equivalent alloying elements.

5 Claims, 1 Drawing Sheet

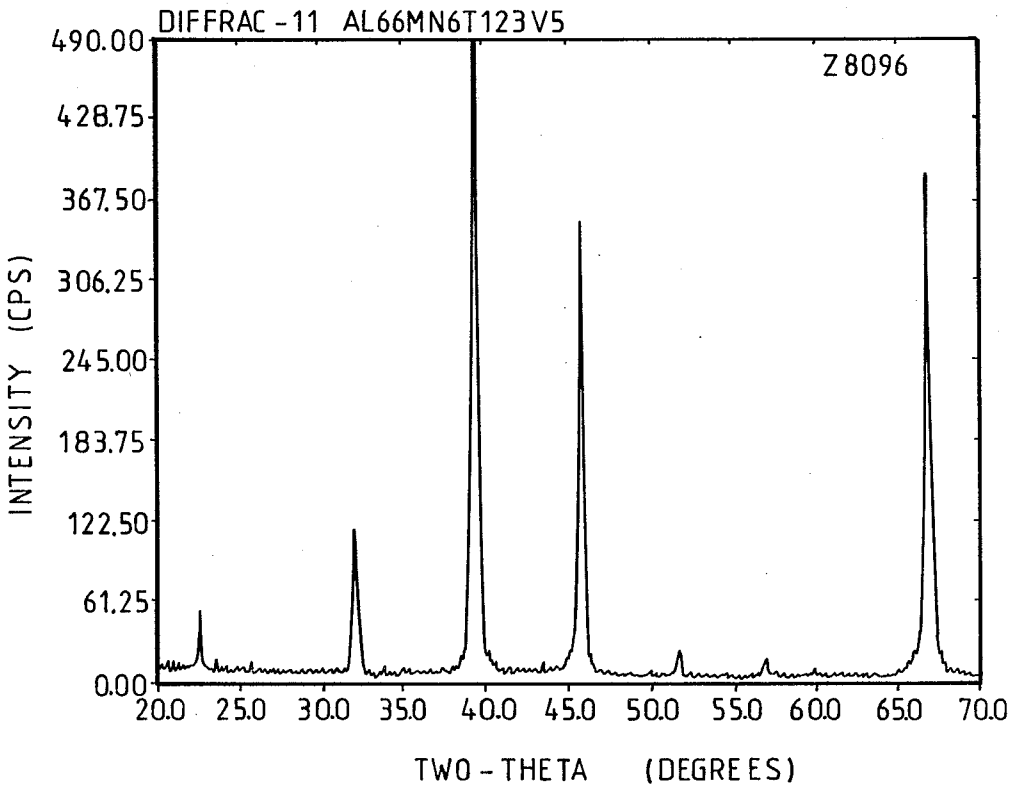
DIFFRAC-11 AL66MN6T123V5
Z8096
INTENSITY (CPS)
490.00
428.75
367.50
306.25
245.00
183.75
122.50
61.25
0.00
20.0
25.0
30.0
35.0
40.0
45.0
50.0
55.0
60.0
65.0
70.0
TWO-THETA (DEGREES)

LOW DENSITY HEAT RESISTANT INTERMETALLIC ALLOYS OF THE $AL_3TI$ TYPE

FIELD OF INVENTION

The present invention relates to aluminum-rich, heat and oxidation resistant alloys of low density and, more particularly, to aluminum-titanium alloy compositions including manganese, or chromium, as well as vanadium and similar alloying elements, as major alloying additions.

BACKGROUND OF INVENTION

Along with the continuing demand for new materials with improved high temperature performance, there has been strong interest, most notably for aerospace systems, in developing high temperature materials of low density and high strength to density ratios for reasons of improved efficiency and economy. It is to be noted that, as discussed in "Superalloys - A Technical Guide" by Elihu F. Bradley, ed., ASM International, Metals Park, OH (1988), common high temperature alloys have densities of the order of 8 g/cc. Those densities are more than twice the densities of the alloys presented by this invention.

The low density binary aluminum-titanium intermetallic alloy $Al_3Ti$ is known to have high strength, high hardness ( 450 HDP), as well as good heat and oxidation resistance, but is extremely brittle at room temperature. M. Yamaguchi, Y. Umakoshi and T. Yamane in "Philosophical Magazine" A, 55 (1987) 301, discuss this phenomenon. Some attempts to enhance these materials for increased utilization have been in the area of investigations of processing technology. However, the prospects for improving the ductility by processing methods are poor, primarily because of the tetragonal ($DO_{22}$) crystal structure, which has less than the requisite number of slip systems required for polycrystalline deformation and ductility. Also, the binary alloy is difficult to prepare. Other aluminum-based alloys of the type $Al_3X$, where X represents elements from Groups IVA and VA of the periodic table, e.g., V, Zr, Nb, Hf and Ta, are known to have similar characteristics. The A subgroup designation used here is that recommended by the International Union of Pure and Applied Chemistry, wherein Group IVA is headed by Ti, Group VA by V, and Group VIA is headed by Cr.

It is well known that alloys with the cubic crystal structure ($Ll_2$) can be more ductile at low temperatures because they possess the requisite number of slip systems. These alloys also often exhibit a positive temperature dependence of compressive strength.

It has been known for some time that tetragonal $Al_3Ti$ can be transformed to the cubic $Ll_2$ structure by ternary addition of Fe, Cu, or Ni. That phenomenon is discussed in the publications: A. Raman and K. Schubert, Z. Metallk, 56 (1965) 99; A. Seibold, Z. Metallk, 72 (1981) 712; and K. S. Kumar and J. R. Pickens, Scripta Met. 22 (1988) 1015. As a specific example, Kumar and Pickens, "Ternary Low-Density Cubic $Ll_2$ Aluminides," Proceedings of the Symposium Dispersion Strengthened Aluminum Alloys, 1988 TMS Annual Meeting, Phoenix, Arizona, Jan. 25–28, 1988 summarize some of these earlier observations, and describe cubic versions of the alloys $Al_5CuTi_2$ and $Al_{22}Fe_3Ti_8$. Reported hardnesses were 330 HDP, with the alloys showing little resistance to cracking in the vicinity of test hardness indentations. In general, alloys of this type have been difficult to produce, suffering from porosity, inhomogeneity, and second phases, all of which can have deleterious effects on mechanical properties. There are also indications that additions of Cu and Fe decrease the resistance to oxidation at high temperatures.

SUMMARY OF THE INVENTION

An object of the invention is to provide low density, aluminum-rich intermetallic alloys having improved ductility and compressive strength characteristics.

Among other objects of the invention are to provide an alloy composition for engineering applications having the cubic structure, with excellent oxidation resistance and elevated temperature properties, and with low density, leading to attractive density-compensated strengths.

Another, specific objective of the invention is to provide an aluminum-titanium composition having suitable ductility at low temperatures.

Additional objects and advantages will be set forth in part in the description which follows, and in part, will become apparent to those skilled in the art upon reviewing the following detailed description and the appended claims.

To achieve the foregoing objects and in accordance with the purpose of the invention, as embodied and broadly described herein, the aluminum-titanium alloy composition of the present invention is modified to include the element manganese, or the element chromium, as substitution for a portion of the aluminum and, in preselected incidents, elements, from Groups IVA or VA, as well as VIA, of the periodic table for a portion of the titanium.

Such a modified alloy in ternary form includes from about 15 to about 35 atomic percent titanium, from about 3 to about 15 atomic percent manganese, or chromium, and the balance substantially aluminum. The addition of manganese, or chromium, stabilizes the cubic modification of $Al_3Ti$. These alloys have been found to have particularly low density, improved ductility, improved resistance to oxidation at elevated temperatures and a positive temperature dependence of compressive strength.

It should be noted that it is believed that, although manganese, or chromium, is believed to be the preferred substitution in this regard, other elements from the above Groups of the periodic table can be used as additional alloying elements in addition to manganese, or chromium, to form quaternary compositions. Thus, in a more specific aspect this invention proposes additional alloying with vanadium. This more specific alloy composition comprises titanium and manganese, or chromium, in the percent ranges set forth above, namely about 15 to about 35 at. pct. titanium and about 3 to about 15 at. pct. manganese, or chromium, but with the addition of up to about 9 at. pct. vanadium. This vanadium addition increases the resistance to cracking.

Preferably, the aluminum-titanium alloy composition includes from about 20 to about 30 at. pct. titanium, from about 4 to about 12 at. pct. manganese, or chromium, about 3 to about 8 at. pct. vanadium, and the balance substantially aluminum. These compositions have a density of about 3.6 g/cc, improved ductility, significant strengths at temperatures near 1000° C., and excellent oxidation resistance. Based on property evaluations and established atomic site substitution behavior, other elements from Groups IVA or VA, as well as VIA, of the periodic table may be used in place of vanadium.

DESCRIPTION OF THE DRAWING

The single sheet of drawing is a reproduction of an x-ray diffraction pattern for a specific alloy, $Al_{66}Mn_6Ti_{28}$ showing that only the cubic $Ll_2$ phase is present.

DESCRIPTION OF THE PREFERRED EMBODIMENT

Reference will now be made in detail to the present preferred embodiments of the invention.

In accordance with the invention, approximately 35 alloys were prepared based on nominal $Al_3Ti$ with varying amounts of aluminum, titanium and manganese; and also with varying amounts of aluminum, titanium, manganese, and vanadium and other Group IVA, VA, and VIA elements, such as Hf, Zr, Nb, Ta, W and Mo, as major alloying elements. Related experiments were also done using chromium in place of the manganese.

Ternary alloys of nominal composition $(Al,Mn)_3Ti$ and quaternary alloys of nominal composition $(Al,Mn)_3$-(Ti,V) were produced in homogeneous form without appreciable porosity by several conventional processing methods including nonconsumable electrode arc melting, and various powder processing methods. In the ternary alloys, the relation maintained was from about 15 to about 35 at. pct. Ti, from about 3 to about 15 at. pct. Mn and the balance substantially Al. In the quaternary alloys, the relation maintained was from about 15 to about 35 at. pct. Ti, from about 3 to 15 at. pct. Mn, up to about 9 at. pct. V and the balance substantially Al. As verified by x-ray diffraction, the crystal structures of these alloys of the desirable compositions are primarily cubic, with negligible amounts of second phases. Further, the intensities measured from the diffraction patterns established that Mn substitutes for Al and, in the case of addition of V, the V substitutes for Ti. Although other intermetallic phases may form in certain alloys, it appears that the tetragonal $DO_{22}$ phase can be avoided in the ternary and quaternary alloy by adhering to the at. pct. guidelines: $Al<68$ , $Mn>6$, and $Ti<28$, or $Al<68$, $Mn>6$, and $Ti+V<28$. The concurrent work established that the manganese can be replaced by chromium with the same results.

Alloys of the invention can be further modified by conventional metallurgical techniques to develop additional advantageous properties. For example, a dispersed phase, such as the commonly employed oxides and borides, can be added to refine the grain structure, or affect the strength. Also, processing technologies including directionally solidified/single crystal castings, or hot extrusion of powders (including rapidly solidified powders), may be useful to developing properties.

Without further elaboration, it is believed that one skilled in the art can, using the preceding description, utilize the present invention to its fullest extent. The following example is presented to exemplify a preferred embodiment of the invention and should not be construed as a limitation thereof.

EXAMPLES

Low density intermetallics based on aluminum with ternary compositions $Al_{66}Mn_6Ti_{28}$, $Al_{67}Mn_6Ti_{27}$, and $Al_{69.7}Mn_{5.3}Ti_{25}$ and quaternary composition $Al_{66}Mn_6Ti_{23}V_5$ were prepared by arc melting of the pure elements both in chunk form and in the form of cold isostatically pressed powder compacts. The x-ray diffraction patterns indicated essentially 100 pct. of the cubic $Ll_2$ phase, and further, that the Mn substituted for Al and the V for Ti, where V was used, in the structure. An example of the diffraction pattern for the alloy $Al_{66}Mn_6Ti_{28}$ is shown in the drawing.

The indentation hardness of the alloys as melted and heat treated for homogenization, e.g., 1000° C. for 16 hours, was about 200 HDP, and as low as 175 HDP, as compared to 450 HDP for binary $Al_3Ti$. The resistance to cracking at diamond pryamid hardness indentations was much greater for these alloys than that for binary $Al_3Ti$, or the cubic versions achieved by alloying with Fe, Cu and Ni. For example, $Al_3Ti$ exhibited significant cracking at an indentation load of 1 kg, while the specific alloys discussed above did not crack until loads of 50 kg. Alloys with vanadium exhibited the greatest resistance to cracking. Parallel work with alloys in which the manganese was replaced by chromium gave similar results.

Compression testing established that the alloys have high strengths which persist to very high temperatures for aluminum-based alloys. This is shown in the following table:

TABLE I

Mechanical Properties of Ternary Alloy $Al_{69.7}Mn_{5.3}Ti_{25}$ with Cubic $Ll_2$ Structure

| Temperature (°C.) | 25 | 400 | 600 | 800 | 900 |
|---|---|---|---|---|---|
| Yield Strength (ksi) | 48 | 45 | 57 | 43 | 34 |

Further, the alloys were able to be deformed plastically in compression at room temperature to strains of the order of 12 to 15 pct. Similar compression tests on the binary $Al_3Ti$ showed no ductility. Geometrical restrictions for the arc melted buttons did not permit tensile specimens to be made. Bend tests on small specimens established some bend ductility but considerably less than in compression.

Samples of the above alloys heated in air at 1000° C. for 24 hours have shown the formation of only a thin oxide layer so that a polished surface retained a high degree of reflectivity.

From the foregoing description, one skilled in the art can easily ascertain the essential characteristics of the invention and, without departing from the spirit or scope thereof, make various changes and modifications to adapt it to various usages

What is claimed is:

1. A low density heat resistant aluminum-titanium alloy composition comprising from about 15 to about 35 atomic percent titanium, from about 3 to about 15 atomic percent manganese, or chromium, and the balance substantially aluminum.

2. An alloy according to claim 1 wherein the formula for the composition is about $Al_{66}Mn_6Ti_{28}$ or $Al_{66}Cr_6Ti_{28}$.

3. An alloy according to claim 1 wherein the composition additionally includes up to about 9 atomic percent vanadium.

4. An alloy according to claim 3 wherein the formula for the composition is about $Al_{66}Mn_6Ti_{23}V_5$ or $Al_{66}Cr_6Ti_{23}V_5$.

5. A low density heat resistant aluminum-titanium alloy composition comprising from about 15 to about 35 atomic percent titanium, from about 3 to about 15 atomic percent of manganese of chromium, and up to about 9 atomic percent of at least one element selected from the group consisting of Zr, Hf, Nb, Ta, Mo and W, and the balance substantially aluminum.

* * * * *